United States Patent [19]

Smith et al.

[11] 4,011,952

[45] Mar. 15, 1977

[54] MANUAL SORTER

[75] Inventors: Craig A. Smith; Leonard Schachner, both of Pittsford, N.Y.

[73] Assignee: Xerox Corporation, Stamford, Conn.

[22] Filed: Jan. 16, 1975

[21] Appl. No.: 541,543

[52] U.S. Cl. ..... 211/10; 211/50

[51] Int. Cl.[2] ..... B42F 7/10

[58] Field of Search ..... 211/10, 11, 50, 126, 211/128; 206/73; 271/173

[56] References Cited

UNITED STATES PATENTS

| | | | |
|---|---|---|---|
| 1,699,025 | 1/1929 | Schultz | 206/73 |
| 1,966,555 | 7/1934 | Feburc | 211/10 X |
| 2,194,802 | 3/1940 | Low | 211/128 X |
| 2,249,265 | 7/1941 | Bauder | 211/11 |
| 3,178,029 | 4/1965 | Meyers | 211/10 |
| 3,233,744 | 2/1966 | Ripps | 211/126 X |
| 3,561,754 | 2/1971 | Gaffron et al. | 271/173 |
| 3,868,019 | 2/1975 | Stemmle | 211/126 |
| D165,194 | 11/1951 | Schiffer | 211/50 |

FOREIGN PATENTS OR APPLICATIONS

| | | | |
|---|---|---|---|
| 262,425 | 2/1913 | Germany | 211/10 |

*Primary Examiner*—James T. McCall
*Assistant Examiner*—Robert W. Gibson, Jr.
*Attorney, Agent, or Firm*—James J. Ralabate; Michael H. Shanahan; Paul Weinstein

[57] ABSTRACT

A manual sorter and reproducing machine including the sorter. The sorter has a plurality of sheet receiving bins arranged one behind the other from front to back. The bins include sheet supporting surfaces which are oriented to provide efficient sheet stacking and jogging as well as ease of use and operator convenience. The sorter is adapted to be positioned adjacent the sheet output device of the machine with its front to back direction being transverse to the direction in which sheets are generally fed into or removed from the sheet output device.

12 Claims, 4 Drawing Figures

MANUAL SORTER

BACKGROUND OF THE INVENTION

This invention relates to a manual sorter which can be used as a throughput aid for a reproducing machine. A reproducing machine including the manual sorter is also provided.

Numerous manual collating devices are known in the prior art which comprise a plurality of bins arranged in a row. Copy sheets are placed serially into each bin to obtain fully collated sets. Normally such manual collators are employed after the production runs have been completed and most often at a separate work station. This represents a substantial loss in throughput for the reproducing operation.

A work organizer has been provided for use with the Xerox 720 copier. This device consists of two vertical rows of generally horizontal sheet receiving bins which are placed to the side of the output tray of the copier. The bins are arranged so that the sheets are placed in them horizontally. This device has proved highly useful for organizing originals for copying and can be employed for collating the output copies.

In addition to manual collators and work organizers, numerous fully automatic sorting and collating devices are known in the prior art wherein the output of a reproducing machine is fed directly to the sorter and the sheets are distributed in a series of bins in order to obtain fully collated sets. Automatic sorters have found considerable application for high speed reproducing machines wherein it is not possible for an operator to keep up with the output of the machine. They have also been used with slower machines where the additional expense of the sorter can be tolerated.

It has been found desirable to provide some type of sorting or collating facility for the user of a low volume reproducing machine such as a xerographic copier. The lower volume machines generally make up to about 25 copies per minute. Such machines are generally employed for making smaller numbers of copies of originals and smaller numbers of sets of such copies. The manual sorters of the prior art, however, due to their location with respect to the reproducing machine and their bin orientations have not proved acceptable as a throughput aid in many cases because of the inability of the operator to keep up with the output of the reproducing machine.

SUMMARY OF THE INVENTION

In accordance with this invention it is believed to be highly desirable to provide a throughput aid such as a manual sorter which can be utilized in conjunction with a reproducing machine to sort the copies manually as they are produced. In order to provide this function without the operator falling behind the output capacity of the reproducing machine, a manual sorter has been developed having a unique arrangement of sheet receiving bins which have been oriented in such a fashion as will be described hereinafter. The bin orientation utilized provides highly effective stacking of the sheets as they are placed in the bins and permits a relatively easy operator motion for removing the sheets from the output device of the reproducing machine and placing them in the respective bins.

In accordance with this invention the manual sorter design offers great convenience to the operator. The sorter is adapted to be positioned adjacent the sheet output device of a reproducing machine. The sorter has a plurality of sheet receiving bins arranged one behind the other from a front portion to a rear portion. A first side portion is provided extending between the front and rear portions. Each of the bins define a sheet receiving opening at a top portion of the sorter, and further include a first surface for supporting a side of a sheet. The first surface extends downwardly and rearwardly from the top portion, and outwardly and forwardly from the side portion. Each of the bins further have a second surface for supporting a first edge of the sheet wherein the second surface extends downwardly from the top portion. A third surface is provided in each bin for supporting a second and different edge of the sheet wherein the third surface extends outwardly and upwardly from the side portion and of the second surface.

The front to back direction of the sorter when used with a reproducing machine is transverse to the direction in which the sheets are normally fed into or removed from the output device. Preferably, the sorter is positioned adjacent the sheet output device of the reproducing machine such as a xerographic copier with the first side portion being adjacent the output device. Various other features of the sorter and reproducing machine of the present invention will become apparent in the detailed description which follows.

The manual sorter, in accordance with this invention, provides for improved stacking and jogging of the sheets in the bins as well as improved operator efficiency and ease of sheet handling as the operator takes the sheets from the reproducing machine output device and places them into the bins of the sorter.

Accordingly, it is an object of the present invention to provide an improved manual sorter.

It is a further object of this invention to provide a sorter as above wherein the bins are oriented to provide improved sheet stacking and ease of operator use.

It is a further object of this invention to provide a reproducing machine including a manual sorter positioned adjacent its sheet output device.

These and other objects will become more apparent from the following description and drawings.

BRIEF DESCRIPTION OF THE DRAWINGS

Referring now to FIG. 1, a manual sorter 10 in accordance with the present invention is shown. The sorter 10 has a plurality of sheet receiving bins 11 arranged one behind the other from a front portion 12 to a rear portion 13 of the sorter. A first side portion 14 of the sorter 10 extends between the front and rear portions. In operation the first side portion 14 is adapted to be positioned adjacent to an output device 15 of a reproducing machine 16 as shown in FIG. 2.

Figure 1:
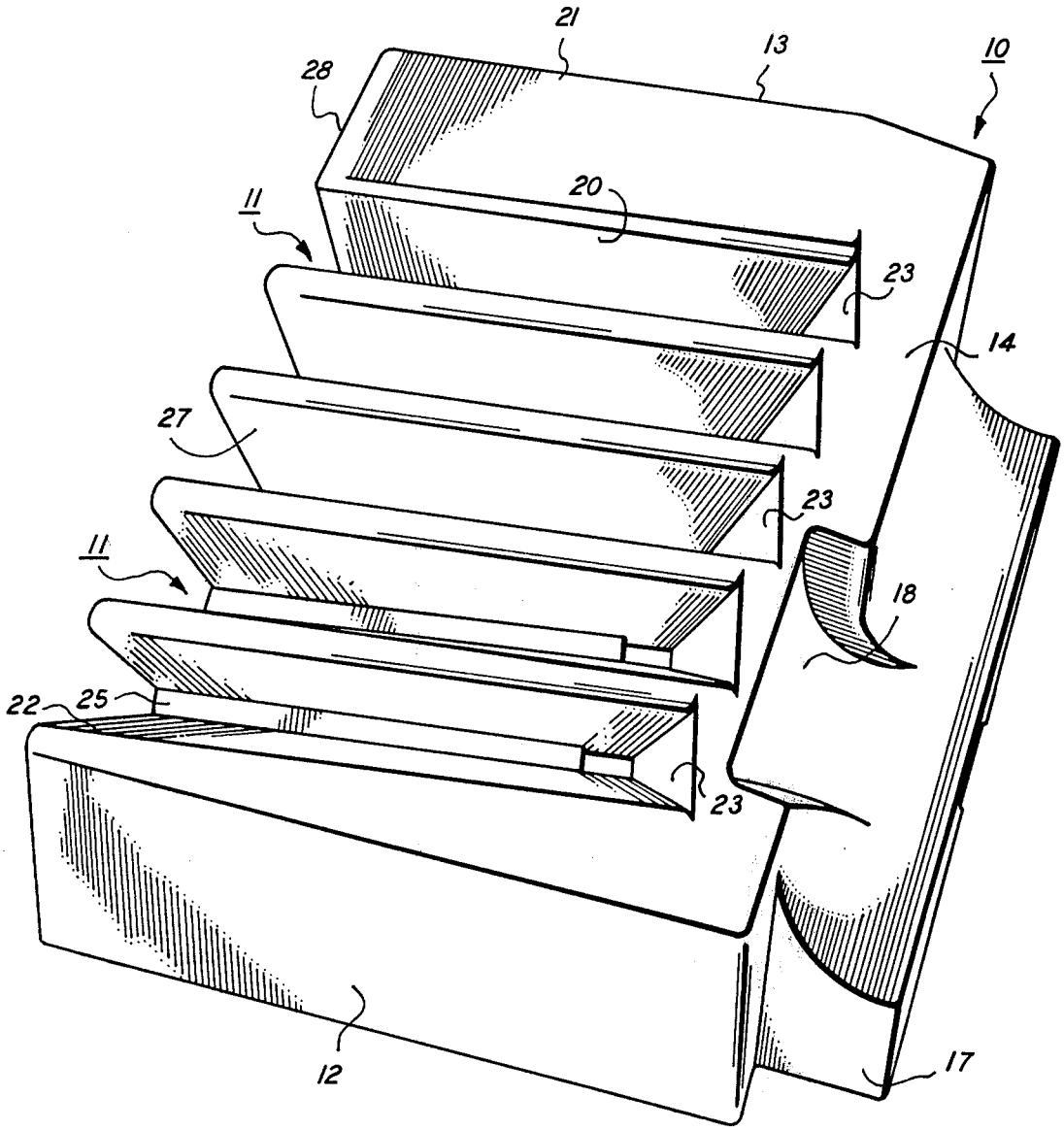
FIG. 1 is a perspective view of a sorter of this invention.

In the sorter 10 shown, the first side portion 14 includes a web section 17 which is adapted to be secured to the reproducing machine 16. The side portion 14 further includes an undercut area 18 for allowing easy access of the operator's hand to a sheet in the output device 15 of the reproducing machine. The use of the web 17 and undercut 18 sections, as shown, is dictated in the embodiment shown by the reproducing machine 16 to which the sorter 10 is attached. For a reproducing machine having a different exterior configuration or sheet output device structure, the shape of the side portion of the sorter could be varied substantially in order to secure the sorter to the machine. The sorter can be secured to any suitable device adjacent the output device 15 such as a table holding the machine. It is only important in accordance with this invention that the sorter 10 be positionable adjacent the sheet output device 15. Therefore, the use of the web section 17 and undercut section 18 represent optional features dependent solely upon machine configuration.

Each of the bins 11 in the sorter 10 define a sheet receiving opening 20 at a top position 21 of the sorter. Referring now to FIGS. 1 through 4, each bin 11 includes a first surface 22 for supporting a side of a sheet. The term side of a sheet as it is employed herein refers to either of the major faces of the sheet. In the preferred embodiment shown the first surface 22 extends downwardly and rearwardly from the top portion 21 and outwardly and forwardly from the side portion 14 of the sorter.

The first surface 22 extends in a generally vertical direction. By this it is meant that it extends vertically to a greater degree than it extends horizontally. It should be apparent that the first surface 22 as defined is inclined to the true vertical. By supporting the sheets in this generally vertical direction stacking of the sheets in the bins 11 is markedly improved as well as the ease of handling the sheets as they are being placed in the bins. For example, it is much easier to hold a sheet in a generally vertical direction than it is to hold it in a generally horizontal direction because of the lack of beam strength in the sheet.

Therefore, by inclining the first surface 22 downwardly and rearwardly of the top portion 21, improved stacking of the sheet in the bins 11 is provided. Inclining the first surface 22 outwardly and forwardly of the side portion 14 provides improved operator efficiency by aligning the bin openings 20 with the natural arc followed by the operator's arm and hand as the operator withdraws the sheet from the output device 15 and places in the sorter bin 11.

Figure 2:
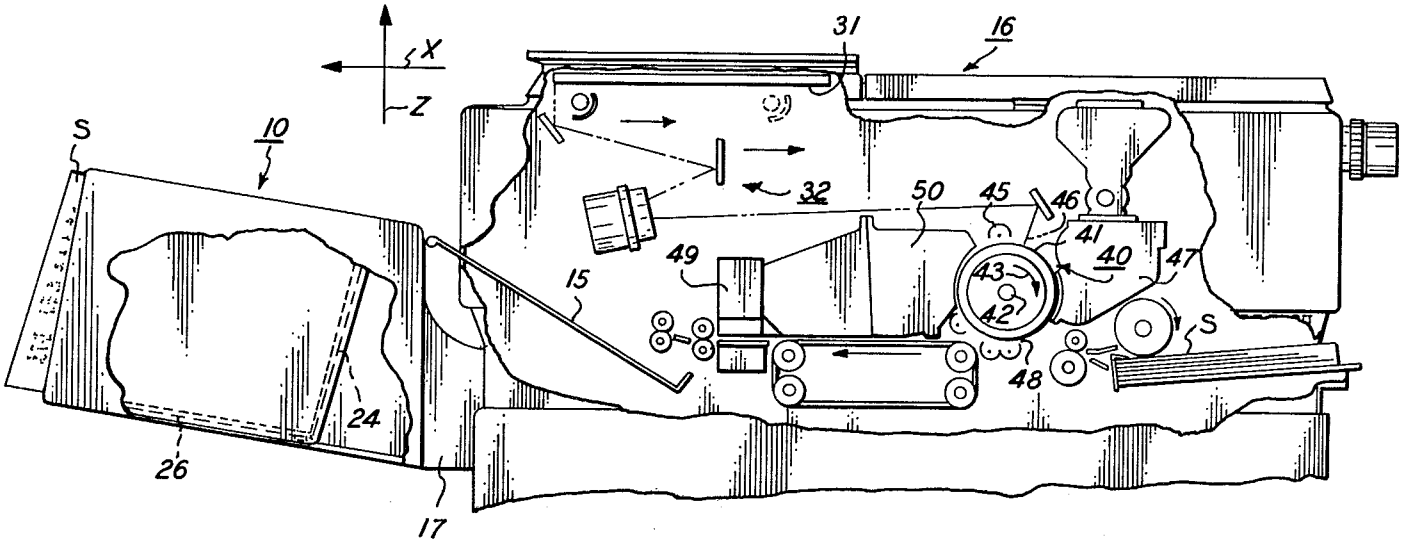
FIG. 2 is a front view of a reproducing machine and manual sorter of this invention. The machine has been partially cut away to schematically show its operating sub-systems. The sorter has been partially cut away to show the bin geometry.
Figure 3:
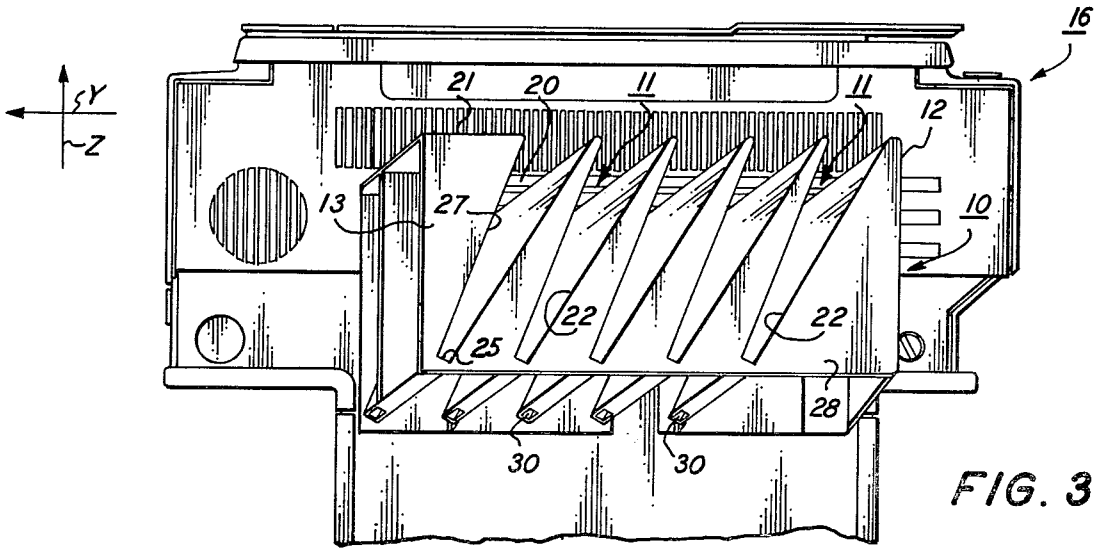
FIG. 3 is a side view of a reproducing machine and sorter of this invention.

In addition to the first sheet support surface, each bin further includes a second surface 23 for supporting a first edge 24 of the sheet S as shown in FIG. 2. The second surface 23 extends downwardly from the top portion 21 of the sorter. A third surface 25 is provided for supporting a second and different edge 26 of the sheet S. The third surface 25 extends outwardly and upwardly from the side portion 14 of the sorter. The third surface 25 extends outwardly of the second surface 23. Preferably, the surfaces 23 and 25 are orthogonally related, namely, they are arranged at a right angle to each other. By orienting the second and third surfaces in the manner just described a sheet placed in a bin 11 will generally slide along the third surface 25 until it intercepts the second surface 23 thereby providing improved stacking and jogging of the sheets in the bins. By orienting the second and third surfaces orthogonally with respect to one another they are adapted to contact orthogonally related first and second edges 24 and 26 possessed by most sheets.

It is apparent from the foregoing that each of the bins 11 has been inclined in space about each of the X, Y, and Z axes. The Z axis is vertical and the X and Y axes are orthogonally arranged in the horizontal plane with the X axis direction corresponding to the horizontal component of the direction in which sheets are removed from the output device 15.

Figure 4:
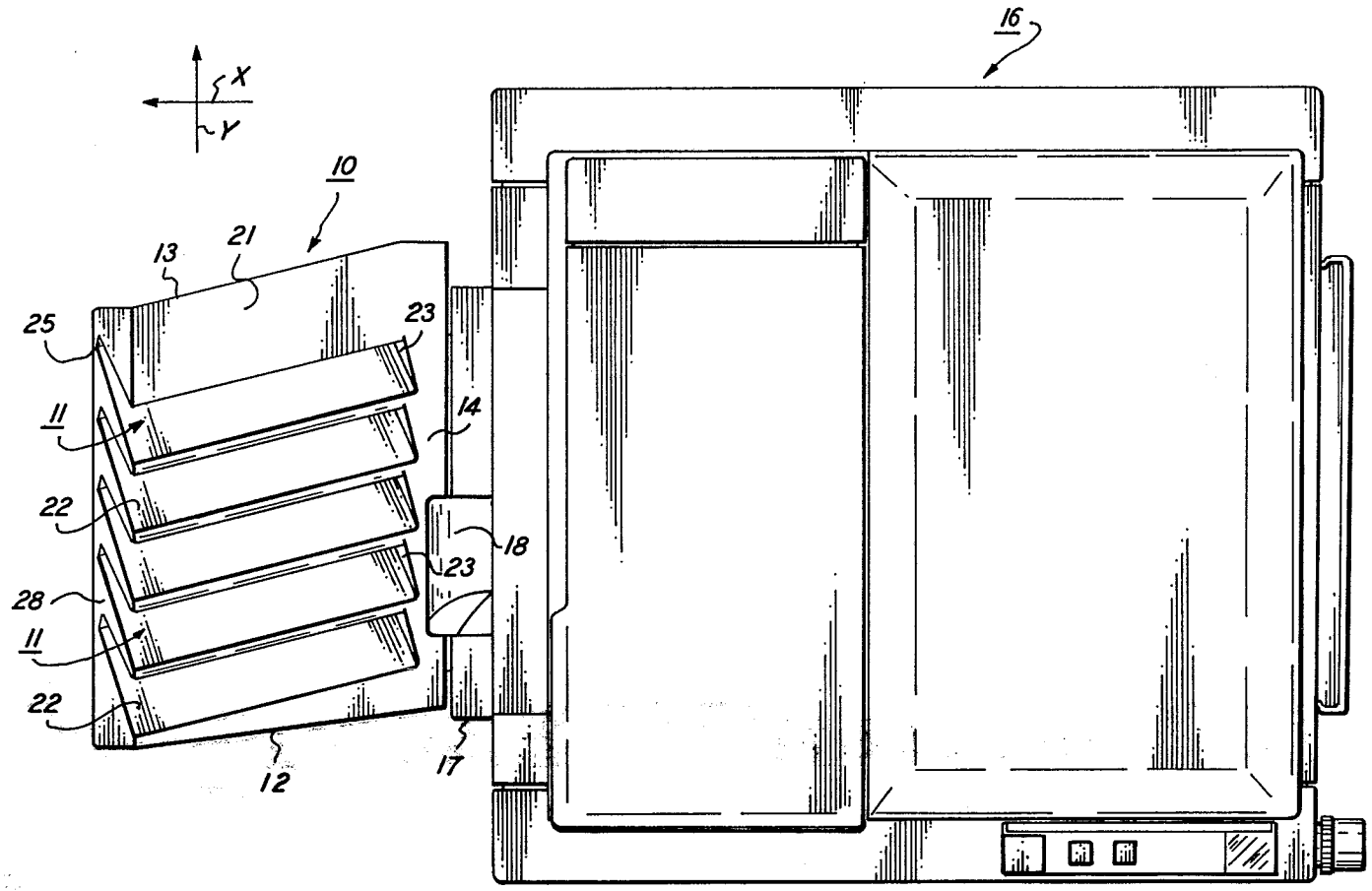
FIG. 4 is a top view of a reproducing machine and a sorter of this invention.

Referring now to FIGS. 2 and 4, it is apparent that the sorter bins 11 of this invention run from the front 12 to the back 13 of the sorter with the front to back direction of the sorter being substantially horizontal and transverse to the direction in which sheets are fed into the output tray which is also the general direction in which they are removed therefrom.

As shown in the Figures, each bin 11 is defined by the three noted surfaces 22, 23, and 25 as well as a bin separating surface 27 opposed to the first surface 22. The bins 11 have a sheet receiving opening 20 as aforenoted and also are open at a second side portion 28 of the sorter which is in opposition to the first side portion 14. A side opening for the bins 11 is desirable since it allows the sorting of documents which have a greater extent than the length of the first and third sheet supporting surfaces. In accordance with the preferred embodiment of this invention the bin gap defined between the first surface 22 and the bin separating surface 27 decreases as one proceeds from the top portion 21 of the sorter toward the third surface 25. It is also preferable that the third surface 25 extend out from the first surface 22 in an othogonal direction. The angle between the third surface 25 and the bin separating surface 27 may be set as desired. By othogonally relating the first and third surfaces fanning of the sheets as they are stacked in the bins is reduced.

Yet another feature of the sorter shown in the Figures comprises the provision of a hole 30 in each of the bins at substantially the lowest portion of the third surface 25, namely, the end of the third surface adjacent the second surface. Due to the incline of the third surface foreign objects such as paper clips which might accidentally fall into the sorter bins 11 slide along the third surface until they reach the opening 30 at which time they fall out of the sorter. This feature is very helpful for keeping the sorter bins clear of foreign objects. However, if desired, the third sheet support surface 25 could be extended to intercept the second surface 23.

The sorter 10 shown herein comprises a one piece integrally molded unit formed of a suitably reinforced plastic. If desired, however, the sorter could be formed of plural members suitably arranged to provide the structure of this invention.

In operation an operator would stand in front of the viewing platen 31 of the reproducing machine 16. Original documents to be copied would be placed upon the viewing platen for scanning by the optics 32 of the machine. While a document is being scanned or otherwise processed by the machine, the copies exiting from the machine into the output tray 15 can be lifted by the operator while standing in the aforenoted position and placed into the appropriate bin 11 of the present sorter 10. For example, when copying on only one side of a sheet which in turn arrives in the tray 15 imaged side up to obtain a properly collated output, namely, to provide a stack wherein the sheets are in their proper numerical sequence, the operator would generally grab the sheet with the thumb contacting the imaged side and the fingers holding the other side of the sheet. The sheet would then be lifted and rotated clockwise for placement in the appropriate bin.

The bin orientations as set forth herein provide for improved stacking of sheets in the bins and operator convenience. Tests have shown that with a device as set forth herein, an operator can conveniently keep up with the output of a machine running at about 20 copies per minute.

The manual sorter of the present invention should have wide application with a variety of reproducing machines wherein the operator can keep up with the normal throughput or output of the machine. The manual sorter of the present invention is believed to have particular utility with lower speed electrostatographic reproducing machines such as the xerographic copier 16 shown schematically in FIG. 2. By positioning the sorter 10 closely adjacent to the output tray 15 of the copier with the row of bins 11 extending substantially horizontally in a direction transverse to the generally horizontal direction in which sheets are fed into or removed from the output tray, the aforenoted manual sorting operation can readily be carried out. There is as set forth above, a direct cooperation between the sorter 10 and the machine 16, namely, the orientation of the bins 11 relative to the output tray 15 and the direction in which sheets are removed therefrom. This cooperation provides for ease of operation and operator convenience.

Referring now to FIG. 2 there is shown by way of example an automatic xerographic reproducing machine 16 which incorporates the manual sorter of the present invention. The reproducing machine 16 depicted in FIG. 2 illustrates the various components utilized therein for producing copies from an original. Although the manual sorter 10 of the present invention is particularly well adapted for use with an automatic xerographic reproducing machine 16, it should be evident from the above description that it is not necessarily limited in its application to the particular embodiment shown herein.

The reproducing machine 16 illustrated in FIG. 2 employs an image recording drum-like member 40, the outer periphery of which is coated with a suitable photoconductive material 41. One type of suitable photoconductive material is disclosed in U.S. Pat. No. 2,970,906, issued to Bixby in 1961. The drum 40 is suitably journaled for rotation within a machine frame (not shown) by means of shaft 42 and rotates in the direction indicated by arrow 43 to bring the image-bearing surface 41 thereon past a plurality of xerographic processing stations. Suitable drive means (not shown) provided to power and coordinate the motion of the various cooperating machine components whereby a faithful reproduction of the original input scene information is recorded upon a sheet of final support material S such as paper or the like.

The practice of xerography is well known in the art and is the subject of numerous patents and texts including *Electrophotography* by Schaffert, published in 1965, and *Xerography and Related Processes* by Dessauer and Clark, published in 1965.

Initially, the drum 40 moves the photoconductive surface 41 through a charging station 45. In the charging station 45, an electrostatic charge is placed uniformly over the photoconductive surface 41 preparatory to imaging. The charging may be provided by a corona generating device of the type described in U.S. Pat. No. 2,836,725, issued to Vyverberg in 1958.

Thereafter, the drum 40 is rotated to exposure station 46 wherein the charged photoconductive surface 41 is exposed to a light image of the original input scene information whereby the charge is selectively dissipated in the light exposed regions to record the original input scene in the form of a latent electrostatic image. A suitable exposure system may be of a type described in U.S. Pat. No. 3,832,057 issued to Shogren, Aug. 27, 1974. After exposure drum 40 rotates the electrostatic latent image recorded on the photoconductive surface 41 to development station 47 wherein a conventional developer mix is applied to the photoconductive surface 41 rendering the latent image visible. A suitable development station is disclosed in U.S. Pat. No. 3,707,947, issued to Reichart in 1973. That patent describes a magnetic brush development system utilizing a magnetizable developer mix having ferromagnetic carrier granules and a toner colorant. The developer mix is brought through a directional flux field to form a brush thereof, the electrostatic latent image recorded on the photoconductive surface 41 is developed by bringing the brush of developer mix into contact therewith.

The developed image on the photoconductive surface 41 is then brought into contact with a sheet S of final support material fed to the drum within a transfer station 48 and the toner image is transferred from the photoconductive surface 41 to the drum contacting side of the final support sheet S. The final support material may be paper, plastic, etc., as desired.

After the toner image has been transferred to the sheet of final support material S the sheet with the image thereon is advanced to a suitable fuser 49 which coalesces the transferred powder image thereto. One type of suitable fuser is described in U.S. Pat. No. 2,701,765, issued to Codichini et al. in 1955. Aftr the fusing process the sheet S is advanced to a suitable output device 15.

Although a preponderance of the toner product is transferred to the final support material S, invariably some residual toner remains on the photoconductive surface 41 after the transfer of the toner powder image to the final support material. The residual toner particles remaining on the photoconductive surface 41 after the transfer operation are removed from the drum 40 as it moves through a cleaning station 50. The toner particles may be mechanically cleaned from the photoconductive surface 41 by any conventional means as, for example, the use of a blade as set forth in U.S. Pat. No. 3,740,789, issued to Ticknor in 1973.

It is believed that the foregoing description is sufficient for purposes of the present application to illustrate the general structure and operation of an automatic xerographic copier 16 which can employ the sorter in accordance with the present invention.

The patents and texts referred to specifically in this applicaton are intended to be incorporated by reference into the application.

It is apparent that there has been provided in accordance with this invention, a manual sorter and reproducing apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A manual sorter apparatus, said sorter having a plurality of sheet receiving bins arranged one behind the other in a substantially horizontal direction from a front portion to a rear portion of said sorter, said sorter further including a first side portion extending between said front and rear portions, each of said bins defining a sheet receiving opening at a top portion of said sorter, said top portion extending between said side, front, and rear portions, each of said bins having a first surface for supporting a side of said sheet, said first surface extending downwardly and rearwardly from said top portion, and outwardly and forwardly from said side portion of said sorter, each of said bins further having a second surface for supporting a first edge of said sheet, said second surface extending downwardly from said top portion, and a third surface for supporting a second and different edge of said sheet, said third surface extending outwardly and upwardly from said side portion, said sorter being adapted to be positioned with said first side portion adjacent a sheet output device of a reproducing machine with said front to back arrangement of said bins being in a direction transverse to the direction in which sheets are fed into said output device. surfaces, said opening allowing small foreign objects to exit from said bins.

2. An apparatus as in claim 1, wherein said second surface and said third surface are arranged at right angles to one another.

3. An apparatus as in claim 1, further including a bin separating surface opposed to said first surface, and wherein a gap is defined between said first surface and said bin separating surface, said gap decreasing as said first surface extends downwardly from said top portion.

4. An apparatus as in claim 1, wherein said bins are open at a second side portion of said sorter opposed to said first side portion.

5. A reproducing apparatus including means for forming images on sheets and a sheet receiving output device receiving said sheets from said imaging means, the improvement wherein said apparatus further includes a manual sorter positioned adjacent said sheet output device, said sorter having a plurality of sheet receiving bins arranged one behind the other in a substantially horizontally extending row from a front portion of said sorter to a rear portion of said sorter, said sorter further including a first side portion extending between said front and rear portions, said first side portion being adjacent said output device, each of said bins defining a sheet receiving opening at a top portion of said sorter, the front to back arrangement of said bins being in a direction transverse to the direction in which sheets are fed into said output device.

6. An apparatus as in claim 5, wherein each of said bins have a first surface for supporting a side of said sheet, said first surface extending downwardly and rearwardly from said top portion and outwardly and forwardly from said side portion of said sorter, each of said bins further having a second surface for supporting a first edge of said sheet, said second surface extending downwardly from said top portion, and a third surface for supporting a second and different edge of said sheet, said third surface extending outwardly and upwardly from said side portion.

7. An apparatus as in claim 6, wherein said second surface and said third surface are arranged at right angles to one another.

8. An apparatus as in claim 7, wherein said third surface and said first surface are arranged at right angles to one another.

9. An apparatus as in claim 6, further including a bin separating surface opposed to said first surface, and wherein a gap is defined between said first surface and said bin separating surface, said gap decreasing as said first surface extends downwardly from said top portion.

10. An apparatus as in claim 6, wherein said bins are open at a second side portion of said sorter opposed to said first side portion.

11. An apparatus as in claim 6, further including an opening defined in each of said third surfaces of said bins adjacent to said second surfaces, said opening allowing small foreign objects to exit from said bins.

12. A manual sorter apparatus, said sorter having a plurality of sheet receiving bins arranged one behind the other from a front portion to a rear portion of said sorter, said sorter further including a first side portion extending between said front and rear portions, each of said bins defining a sheet receiving opening at a top portion of said sorter, each of said bins having a first surface for supporting a side of said sheet, said first surface extending downwardly and rearwardly from said top portion and outwardly and forwardly from said side portion of said sorter, each of said bins further having a second surface for supporting a first edge of said sheet, said second surface extending downwardly from said top portion, and a third surface for supporting a second and different edge of said sheet, said third surface extending outwardly and upwardly from said side portion, said sorter further including an opening defined in each of said third surfaces of said bins adjacent to said second surfaces, said opening allowing small foreign objects to exit from said bins.

* * * * *

UNITED STATES PATENT AND TRADEMARK OFFICE

CERTIFICATE OF CORRECTION

PATENT NO. : 4,011,952

DATED : March 15, 1977

INVENTOR(S) : Craig A. Smith, et al.

It is certified that error appears in the above-identified patent and that said Letters Patent are hereby corrected as shown below:

In column 7, line 26, delete "surfaces,"; in line 27, delete "said opening allowing small foreign objects to exit from"; and in line 28, delete "said bins.".

Signed and Sealed this

Seventh Day of June 1977

[SEAL]

*Attest:*

RUTH C. MASON
*Attesting Officer*

C. MARSHALL DANN
*Commissioner of Patents and Trademarks*